US009704438B2

(12) United States Patent
Lee

(10) Patent No.: US 9,704,438 B2
(45) Date of Patent: Jul. 11, 2017

(54) ORGANIC LIGHT-EMITTING DIODE DISPLAY INCLUDING A PIXEL CIRCUIT HAVING A COMPENSATION UNIT

(71) Applicant: Samsung Display Co., Ltd., Yongin, Gyeonggi-Do (KR)

(72) Inventor: Gi-Chang Lee, Asan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/521,358

(22) Filed: Oct. 22, 2014

(65) Prior Publication Data

US 2015/0348463 A1 Dec. 3, 2015

(30) Foreign Application Priority Data

May 29, 2014 (KR) ..... 10-2014-0064984

(51) Int. Cl.
*G09G 3/32* (2016.01)
*G09G 3/3283* (2016.01)
*G09G 3/3233* (2016.01)

(52) U.S. Cl.
CPC ..... *G09G 3/3283* (2013.01); *G09G 3/3233* (2013.01); *G09G 2300/043* (2013.01); *G09G 2300/0819* (2013.01); *G09G 2300/0842* (2013.01); *G09G 2300/0861* (2013.01); *G09G 2320/0285* (2013.01); *G09G 2320/0295* (2013.01); *G09G 2320/045* (2013.01); *G09G 2320/0693* (2013.01)

(58) Field of Classification Search
USPC ..... 345/82, 78
See application file for complete search history.

(56) References Cited

U.S. PATENT DOCUMENTS

2002/0044140 A1 4/2002 Inukai
2006/0028408 A1 2/2006 Kim
2008/0252568 A1* 10/2008 Kwon ..... G09G 3/3233 345/76
2011/0025659 A1 2/2011 Kwak et al.
(Continued)

FOREIGN PATENT DOCUMENTS

KR 10-2001-0098682 A 11/2001
KR 10-2005-0104816 A 11/2005
(Continued)

*Primary Examiner* — Long D Pham
(74) *Attorney, Agent, or Firm* — Knobbe Martens Olson & Bear LLP

(57) ABSTRACT

A pixel circuit and organic light-emitting diode (OLED) display including the same are disclosed. In one aspect, a pixel circuit comprises an OLED electrically connected between a first node and a low power supply voltage, a driver electrically connected to the OLED at the first node and configured to drive the OLED with a voltage corresponding to a data signal based at least in part on a scan signal, a read-out unit configured to measure an anode current of the OLED based at least in part on a read control signal, and a compensation unit electrically connected to the OLED at the first node and configured to provide the OLED with a compensation current corresponding to a compensation data signal based at least in part on the measured anode current and a compensation control signal.

16 Claims, 8 Drawing Sheets

(56) References Cited

U.S. PATENT DOCUMENTS

| | | | | |
|---|---|---|---|---|
| 2011/0210958 | A1* | 9/2011 | Yoo | G09G 3/325<br>345/214 |
| 2011/0298836 | A1 | 12/2011 | Komiya et al. | |
| 2014/0146028 | A1* | 5/2014 | Choi | G09G 3/3225<br>345/212 |
| 2014/0168194 | A1* | 6/2014 | Kong | G09G 3/3233<br>345/212 |

FOREIGN PATENT DOCUMENTS

| | | | |
|---|---|---|---|
| KR | 10-2006-0000754 | A | 1/2006 |
| KR | 10-2006-0023671 | A | 3/2006 |
| KR | 10-2007-0079388 | A | 8/2007 |
| KR | 10-2011-0011942 | A | 2/2011 |
| KR | 10-2011-0133281 | A | 12/2011 |

* cited by examiner

ORGANIC LIGHT-EMITTING DIODE DISPLAY INCLUDING A PIXEL CIRCUIT HAVING A COMPENSATION UNIT

CROSS REFERENCE TO RELATED APPLICATION

This application claims priority under 35 U.S.C. §119 to Korean Patent Application No. 10-2014-0064984 filed on May 29, 2014, the disclosure of which is hereby incorporated by reference herein in its entirety.

BACKGROUND

Field

The described technology generally relates to pixel circuits, and organic light-emitting diode (OLED) displays including the same.

Description of the Related Technology

Many flat panel display technologies have been developed. Examples of flat panel displays include a liquid crystal display (LCD), a field emission display (FED) device, a plasma display panel (PDP), an organic light-emitting diode (OLED) display, etc. An OLED display has advantages such as rapid response speed and low power consumption relative to the other flat panel displays because the OLED display generates an image using an OLED that emits light based on recombination of electrons and holes.

Typically, OLED displays can be categorized into a passive matrix type OLED (PMOLED) display and an active matrix type OLED display AMOLED according to a method of driving organic light-emitting elements. The AMOLED device has a plurality of scan lines, a plurality of data lines, and a plurality of pixel circuits. The AMOLED display can control a gray level of each pixel circuit by adjusting voltage data or current data (e.g., in an analog driving method), or by adjusting light emission time (e.g., in a digital driving method).

SUMMARY OF CERTAIN INVENTIVE ASPECTS

One inventive aspect is a pixel circuit of an OLED display, capable of operating in a digital driving manner and compensating for deterioration of electric characteristics.

Another aspect is an OLED display including a pixel circuit capable of operating in a digital driving manner and compensating for deterioration of electric characteristics.

Another aspect is a pixel circuit that includes an OLED connected between a first node and a low power supply voltage, a driving unit, a read out unit and a compensation unit. The driving unit is connected to the OLED at the first node and the driving unit drives the OLED with a voltage corresponding to a data signal in response to a scan signal. The read out unit detects an anode current of the OLED in response to read control signal. The compensation unit is connected to the OLED at the first node and the compensation unit provides the OLED with a compensation current corresponding to a compensation data signal based on a level of the anode current, in response to a compensation control signal.

In example embodiments, the driving unit may include a first switching transistor, a storage capacitor, and a first driving transistor. The first switching transistor may transfer the data signal provided from a data line, in response to the scan signal. The storage capacitor may store the data signal transferred through the first switching transistor and the storage capacitor may be connected to a first high power supply voltage and may be connected to the first switching transistor at a second node. The first driving transistor may drive the OLED in response to a driving voltage at the second node and the driving voltage may be based on the data signal stored in the storage capacitor.

The first switching transistor may include a first p-channel metal oxide semiconductor (PMOS) transistor having a first terminal coupled to the data line, a gate terminal receiving the scan signal and a second terminal coupled to the second node. The first driving transistor may include a second PMOS transistor that has a first terminal coupled to the first high power supply voltage, a gate terminal coupled to the second node and a second terminal coupled to the first node.

In example embodiments, the compensation unit may include a second switching transistor, a compensation capacitor, a second driving transistor and a third driving transistor. The second switching transistor may transfer the compensation data signal provided from a compensation data line, in response to the compensation control signal. The compensation capacitor may store the compensation data signal transferred through the second switching transistor and the compensation capacitor may be connected to a second high power supply voltage and may be connected to the second switching transistor at a third node. The second driving transistor may be turned on or turned off in response to a compensation voltage at the third node and the compensation voltage may be based on the compensation data signal stored in the compensation capacitor. The third driving transistor may be turned on or turned off in response to the driving voltage at the second node and the third driving transistor may be connected between the second driving transistor and the first node.

The second switching transistor may include a first p-channel metal oxide semiconductor (PMOS) transistor having a first terminal coupled to the compensation data line, a gate terminal receiving the compensation control signal and a second terminal coupled to the third node. The second driving transistor may include a second PMOS transistor having a first terminal coupled to the second high power supply voltage, a gate terminal coupled to the third node and a second terminal coupled to the first PMOS transistor. The third driving transistor may include a third PMOS transistor having a first terminal coupled to the first driving transistor, a gate terminal coupled to the second node and a second terminal coupled to the first node.

When the second PMOS transistor is turned on in response to the compensation voltage and the third PMOS transistor is turned on in response to the driving voltage, the compensation current may be provided to the OLED.

A level of the second high power supply voltage may be equal to or greater than a level of the first high power supply voltage.

When the OLED may emit light in response to the data signal, a level of the compensation voltage is proportional to a level of the anode current detected by the read out unit.

In example embodiments, the read out unit may include a second switching transistor configured to provide the anode current to a read line in response to the read control signal. The second switching transistor may include a p-channel metal oxide semiconductor (PMOS) having a first terminal receiving the anode current, a gate terminal receiving the read control signal and a second terminal coupled to the read line.

In example embodiments, the read out unit and the compensation unit may operate independently with respect to the driving unit.

A read out operation of the read out and a compensation operation of the compensation unit may not overlap with respect to each other When the OLED does not emit light in response to the data signal, the compensation unit may not perform a compensation operation.

Another aspect is an organic light emitting display device that includes a pixel unit, a scan driver, a data driver, a timing controller and a power generator. The pixel unit includes a plurality of pixel circuits and each pixel circuit is connected to the data driver through a data line, a compensation data line and a read line. Each pixel circuit includes an OLED connected between a first node and a low power supply voltage, a driving unit, a read out unit and a compensation unit. The driving unit is connected to the OLED at the first node and the driving unit drives the OLED with a voltage corresponding to a data signal in response to a scan signal. The read out unit detects an anode current of the OLED in response to read control signal. The compensation unit is connected to the OLED at the first node and the compensation unit provides the OLED with a compensation current corresponding to a compensation data signal based on a level of the anode current, in response to a compensation control signal.

In example embodiments, the data driver may include a frame memory configured to store compensation data of each pixel circuit and a compensation circuit configured to selectively update the compensation data based on the anode current and the compensation data.

The compensation circuit may include a voltage to current converter configured to convert a first compensation data stored in the frame memory to a corresponding first compensation data, a first comparator configured to compare the anode current with a zero current to provide a first comparison signal, a calculator that operates in response to the first comparison signal, and configured to calculate a difference between the anode current and the first compensation current to provide a difference current, a second comparator configured to compare the difference current with a reference current to provide a second comparison signal and a bit controller configured to generate a bit control signal directing whether the compensation data is updated, in response to the second comparison signal.

The calculator may be disabled in response to the first comparison signal when the anode current is equal to the zero current.

The calculator may be enabled in response to the first comparison signal when the anode current is greater than the zero current. The bit controller may generate the bit control signal in response to the second comparison signal such that the compensation data is maintained when the difference current is equal to or smaller than the reference current.

The calculator may be enabled in response to the first comparison signal when the anode current is greater than the zero current. The bit controller may generate the bit control signal in response to the second comparison signal such that the compensation data is changed when the difference current is greater than the reference current.

In example embodiments, the frame memory may include a first region that stores the compensation data of each pixel circuit and a second region that stores particle bits. Each particle bit may indicate whether the OLED in each pixel circuit has a particle.

In example embodiments, when the OLED emits lights in response to the data signal, the compensation circuit may generate the compensation current having a level that compensates for decreased portion of the anode current and the decreased portion of the anode current is caused by at least one of a deterioration of the OLED coupled between a high power supply voltage and a low power supply voltage and a voltage drop of the high power supply voltage according to a position of the pixel circuit in the pixel unit.

A pixel circuit for displaying an image, comprising an organic light-emitting diode (OLED) electrically connected between a first node and a low power supply voltage, a driver electrically connected to the OLED at the first node and configured to drive the OLED with a voltage corresponding to a data signal based at least in part on a scan signal, a read-out unit configured to measure an anode current of the OLED based at least in part on a read control signal, and a compensation unit electrically connected to the OLED at the first node and configured to provide the OLED with a compensation current corresponding to a compensation data signal based at least in part on the measured anode current and a compensation control signal.

In the above pixel circuit, the driver comprises a first switching transistor configured to, based at least in part on the scan signal, transmit the data signal received from a data line, a storage capacitor configured to store the data signal transmitted through the first switching transistor, wherein the storage capacitor is electrically connected to a first high power supply voltage on one end and the first switching transistor on the other end at a second node. In the above pixel circuit, the driver further comprises a first driving transistor configured to drive the OLED based at least in part on a driving voltage at the second node, wherein the driving voltage is based at least in part on the data signal stored in the storage capacitor.

In the above pixel circuit, the first switching transistor includes a first p-channel metal oxide semiconductor (PMOS) transistor having a first terminal electrically connected to the data line, a gate terminal configured to receive the scan signal and a second terminal electrically connected to the second node. In the above pixel circuit, the first switching transistor further includes a second PMOS transistor having a first terminal electrically connected to the first high power supply voltage, a gate terminal electrically connected to the second node and a second terminal electrically connected to the first node.

In the above pixel circuit, the compensation unit comprises a second switching transistor configured to, based at least in part on the compensation control signal, transmit the compensation data signal received from a compensation data line. In the above pixel circuit, the compensation unit further comprises a compensation capacitor configured to store the compensation data signal transmitted from the second switching transistor and electrically connected to a second high power supply voltage on one end and electrically connected to the second switching transistor on the other end at a third node. In the above pixel circuit, the compensation unit further comprises a second driving transistor configured to be turned on or turned off based at least in part on a compensation voltage at the third node, wherein the compensation voltage is based at least in part on the compensation data signal stored in the compensation capacitor. In the above pixel circuit, the compensation unit further comprises a third driving transistor configured to be turned on or turned off based at least in part on the driving voltage at the second node and electrically connected between the second driving transistor and the first node.

In the above pixel circuit, the second switching transistor includes a first p-channel metal oxide semiconductor (PMOS) transistor having a first terminal electrically connected to the compensation data line, a gate terminal configured to receive the compensation control signal and a second terminal electrically connected to the third node. In the above pixel circuit, the second switching transistor further includes a second PMOS transistor having a first terminal electrically connected to the second high power supply voltage, a gate terminal electrically connected to the third node and a second terminal electrically connected to the first PMOS transistor, wherein the third driving transistor includes a third PMOS transistor having a first terminal electrically connected to the first driving transistor, a gate terminal electrically connected to the second node and a second terminal electrically connected to the first node.

In the above pixel circuit, the OLED is configured to receive the compensation current when the second and third PMOS transistors are turned on.

In the above pixel circuit, a level of the second high power supply voltage is substantially equal to or greater than a level of the first high power supply voltage.

In the above pixel circuit, when the OLED emits light based at least in part on the data signal, a level of the compensation voltage is proportional to a level of the measured anode current.

In the above pixel circuit, the read-out unit comprises a second switching transistor configured to provide the anode current to a read line based at least in part on the read control signal, wherein the second switching transistor includes a p-channel metal oxide semiconductor (PMOS) having a first terminal configured to receive the anode current, a gate terminal configured to receive the read control signal and a second terminal electrically connected to the read line.

In the above pixel circuit, the read-out unit and the compensation unit are configured to operate independently with respect to the driver. In the above pixel circuit, the read-out unit is further configured to measure the anode current, wherein the compensation unit is further configured to provide the compensation current at different times.

In the above pixel circuit, when the OLED does not emit light, the compensation unit is further configured to not output the compensation current to the OLED.

Another aspect is an organic light-emitting diode (OLED) display for displaying an image, the OLED display comprising a plurality of pixel circuits. Each pixel circuit comprises an OLED electrically connected between a first node and a low power supply voltage, an OLED driver electrically connected to the OLED at the first node and configured to drive the OLED with a voltage corresponding to a data signal based at least in part on a scan signal, a read-out unit configured to measure an anode current of the OLED based at least in part on a read control signal, and a compensation unit electrically connected to the OLED at the first node and configured to provide the OLED with a compensation current corresponding to a compensation data signal based at least in part on the measured anode current and a compensation control signal. The OLED display further comprises a data driver electrically connected to the pixel circuits through a plurality of data lines, a plurality of compensation lines and a plurality of read lines, a scan driver electrically connected to the pixel circuits through a plurality of scan lines, a timing controller configured to provide control signals to the scan driver and the data driver, and a power supply configured to supply a plurality of power supply voltages including the low power supply voltage to the pixel unit.

In the above pixel circuit, the data driver comprises a frame memory configured to store compensation data of each pixel circuit and a compensation circuit configured to selectively update the compensation data based at least in part on the anode current and the compensation data.

In the above pixel circuit, the compensation circuit comprises a voltage-to-current converter configured to convert a first compensation data stored in the frame memory to a first compensation data, a first comparator configured to compare the anode current with a zero current so as to output a first comparison signal, a calculator configured receive the first comparison signal and calculate, based at least in part on the first comparison signal, the difference between the anode current and the first compensation current so as to output a difference current. In the above pixel circuit, the compensation circuit further comprises a second comparator configured to compare the difference current to a reference current so as to output a second comparison signal and a bit controller configured to, based at least in part on the second comparison signal, generate a bit control signal so as to update the compensation data.

In the above pixel circuit, the calculator is further configured to be disabled based at least in part on the first comparison signal when the anode current is substantially equal to the zero current.

In the above pixel circuit, the calculator is further configured to be enabled based at least in part on the first comparison signal when the anode current is greater than the zero current, wherein the bit controller is further configured to generate the bit control signal based at least in part on the second comparison signal so as to maintain the compensation data when the difference current is substantially equal to or less than the reference current.

In the above pixel circuit, the calculator is further configured to be enabled based at least in part on the first comparison signal when the anode current is greater than the zero current, wherein the bit controller is further configured to generate the bit control signal based at least in part on the second comparison signal so as to change the compensation data when the difference current is greater than the reference current.

In the above pixel circuit, the frame memory comprises a first region configured to store the compensation data of each pixel circuit and a second region configured to store particle bits, each particle bit configured to indicate whether the OLED in each pixel circuit has a contaminating particle.

In the above pixel circuit, when the OLED emits light based at least in part on the data signal, the compensation unit is further configured to generate the compensation current having a level that compensates for a decreased amount of the anode current, wherein the decreased amount of the anode current is caused by at least one of a degradation of the OLED electrically connected between a high power supply voltage and a low power supply voltage and a voltage drop of the high power supply voltage according to a position of the pixel circuit in the pixel unit.

Accordingly, the pixel circuit according to example embodiments may perform compensation operation according to a level of the anode current of the OLED.

In addition, the OLED display may include the pixel circuit including a read out unit for detecting the anode current of the OLED and a compensation unit that provides the OLED with a compensation current corresponding to a compensation data signal based on the level of the anode current and thus may individually compensate for decreased portion of the anode current which is caused by at least one of a deterioration of the OLED and a voltage drop of the first high power supply voltage according to a position of the pixel circuit.

DETAILED DESCRIPTION OF CERTAIN INVENTIVE EMBODIMENTS

Figure 1:
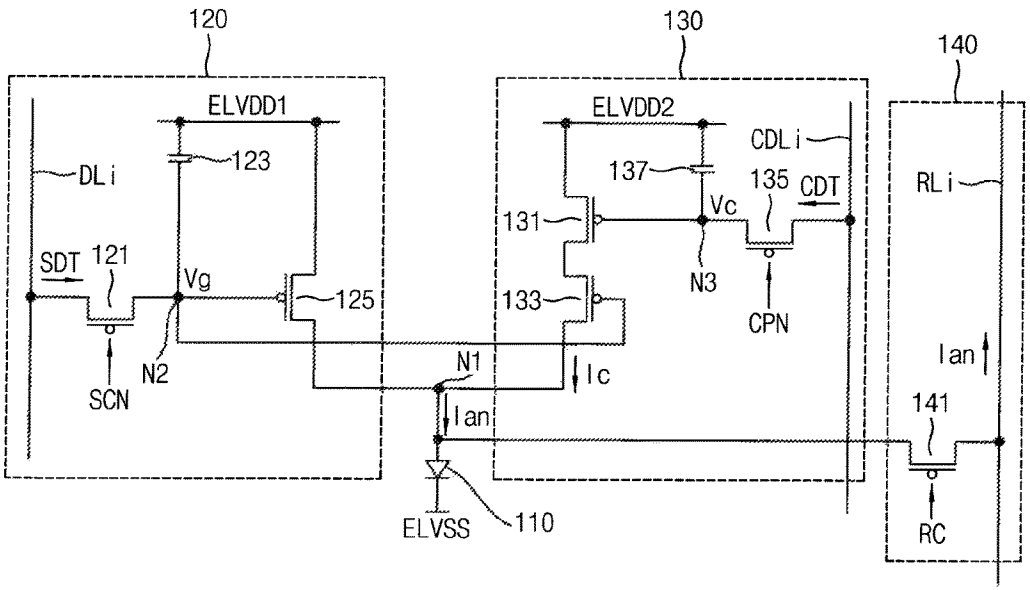
FIG. 1 is a circuit diagram illustrating a pixel circuit of an organic light-emitting diode (OLED) display according to example embodiments.

While an analog driving method for an OLED display produces grayscale with a variable voltage level of data, a digital driving method produces grayscale with variable duration during which an OLED emits light. In manufacturing a driving integrated circuit (IC) with a large display panel and high resolution, it is difficult to implement analog driving. On the other hand, the digital driving method with high resolution can be more easily implemented through a simpler IC structure. Therefore, digital driving methods are useful for large panels and high resolution. However, the digital driving method can be sensitive to variances of the OLED and small voltage drops of power supply voltage. Furthermore, OLEDs tend to easily degrade with age.

The example embodiments are described more fully hereinafter with reference to the accompanying drawings. The described technology can, however, be embodied in many different forms and should not be construed as limited to the example embodiments set forth herein. In the drawings, the sizes and relative sizes of layers and regions can be exaggerated for clarity.

It will be understood that when an element or layer is referred to as being "on," "connected to" or "coupled to" another element or layer, it can be directly on, connected or coupled to the other element or layer or intervening elements or layers can be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. can be used herein to describe various elements, components, regions, layers, patterns and/or sections, these elements, components, regions, layers, patterns and/or sections should not be limited by these terms.

The terminology used herein is for the purpose of describing particular example embodiments only and is not intended to be limiting of the described technology. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the described technology. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the described technology.

Unless otherwise defined, all terms (including technical and scientific terms) used herein have the same meaning as commonly understood by one of ordinary skill in the art to which this described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a circuit diagram illustrating a pixel circuit of an organic light-emitting diode (OLED) display according to example embodiments.

Referring to FIG. 1, a pixel circuit 100 of an OLED display includes an OLED 110, a driving unit or driver or OLED driver 120, a compensation unit 130 and a read-out unit 140.

The driving unit 120 is connected to an anode of the OLED 110 at a first node N1 and includes a first switching transistor 121, a storage capacitor 123 and a first driving transistor 125.

The first switching transistor 121 can include a first p-channel metal oxide semiconductor (PMOS) transistor 121 having a first terminal (e.g., a source terminal) coupled to a data line DLi, a gate terminal that can receive a scan signal SCN and a second terminal (e.g., a drain terminal) coupled to a second node N2.

The storage capacitor 123 can store a data signal SDT transferred through the switching transistor 121. In some embodiments, the storage capacitor 123 can have a first electrode (e.g., a positive electrode) coupled to a first high power supply voltage ELVDD1 and a second electrode coupled to the second node.

The first driving transistor 125 can drive the OLED 110 in response to a driving voltage Vg at the second node N2 corresponding to the data signal SDT stored in the storage capacitor 123. The first driving transistor 125 can include a PMOS transistor 125 having a first terminal coupled to the first high power supply voltage ELVDD1, a gate terminal coupled to the second node N2 and receiving the driving voltage Vg and a second terminal coupled to the OLED 110 at the first node N1.

The OLED 110 can be coupled between the first node N1 and a low power supply voltage ELVSS. The OLED 110 can have an anode electrode coupled to the first node N1 and a cathode electrode coupled to the low power supply voltage ELVSS.

For example, when the data signal SDT has a first logic level (e.g., a voltage level of about ELVDD1-5V), a current can flow from the storage capacitor 123 to the data line DLi through the PMOS transistor 121, and the storage capacitor can be charged to store a voltage of about 5V. Therefore, the driving voltage Vg can have a voltage of about 5V. When the driving voltage Vg of about the first high power supply voltage ELVDD1 is applied to the gate terminal of the PMOS transistor 125, the PMOS transistor 125 can be turned off. Accordingly, in some embodiments, a current path from the first high power supply voltage ELVDD1 to the low power supply voltage ELVSS is not formed and a voltage between both ends of the OLED 110 can be about 0V. Thus, the OLED 110 does not emit light.

In another example, when the data signal SDT has a second logic level (e.g., a voltage level of ELVDD), the storage capacitor 123 can store a voltage of about 0 V. Therefore, the driving voltage Vg can have a voltage of about 0V. When the driving voltage Vg of about 0V is applied to the gate terminal of the PMOS transistor 125, the PMOS transistor 125 can be turned on. Accordingly, a current path from the first high power supply voltage ELVDD1 to the low power supply voltage ELVSS can be formed and a voltage between both ends of the OLED 110 can correspond to a voltage difference between the first high power supply voltage ELVDD1 and the low power supply voltage ELVSS. Thus, the OLED 110 can emit light. Therefore, the driving unit 120 can drive the OLED 110 with the driving voltage Vg corresponding to the data signal SDT.

The compensation unit 130 can include a second driving transistor 131, a third driving transistor 133, a second switching transistor 135 and a compensation capacitor 137.

The second switching transistor 135 can include a PMOS transistor 135 having a first terminal coupled to a compensation data line CDLi, a gate terminal that can receive a compensation control signal CPN and a second terminal coupled to a third node N3.

The compensation capacitor 137 can store a compensation data signal CDT transferred through the second switching transistor 135. The compensation capacitor 137 can have a first electrode coupled to a second high power supply voltage ELVDD2 and a second electrode coupled to the third node N3. A level of the second high power supply voltage ELVDD2 can be substantially equal to or greater than a level of the first high power supply voltage ELVDD1.

The second driving transistor 131 can include a PMOS transistor 131 having a first terminal coupled to the second high power supply voltage ELVDD2, a gate terminal coupled to the third node N3 and that can receive a compensation voltage Vc corresponding to the compensation data signal CDT stored in the compensation capacitor 137, and a second terminal coupled to the third driving transistor 133. The second driving transistor 131 can be turned on or turned off in response to the compensation voltage Vc.

The third driving transistor 133 can include a PMOS transistor 131 having a first terminal coupled to the second driving transistor 131, a gate terminal coupled to the second node N2 and that can receive the driving voltage Vg, and a second terminal coupled to the first node N12. The third driving transistor 133 can be turned on or turned off in response to the driving voltage Vg.

When the second and third driving transistors 131 and 133 are substantially simultaneously turned on, a compensation current Ic corresponding to the compensation voltage Vc can be provided to the OLED 110 from the third node N3. Therefore, the OLED 110 can emit light with a luminance corresponding to a voltage between both ends of the OLED 110 while the first through third driving transistors 125, 131 and 133 are turned on. That is, the compensation unit 130 can provide the OLED 110 with the compensation current Ic corresponding to the compensation data signal CDT based on the level of the anode current Ian, in response to the compensation control signal CPN.

The compensation data signal CDT can have a level that compensates for a decreased amount of the anode current Ian which is caused by at least one of a deterioration of the OLED 110 and a voltage drop of the first high power supply voltage ELVDD1 according to a position of the pixel circuit 100.

The read-out unit 140 can include a third switching transistor 141 coupled between the first node N1 and a read line RLi.

The third switching transistor 141 can include a PMOS transistor 141 having a first terminal to which the anode current Ian is applied, a gate terminal that can receive a read control signal RC and a second terminal coupled to the read line RLi. The third switching transistor 141 can provide the anode current Ian to the read line RLi in response to the read control signal RC. That is, the read-out unit 140 can detect the anode current Ian of the OLED 110 in response to the read control signal RC.

As described above, the pixel circuit 100 includes the read-out unit 140 for detecting the anode current Ian of the OLED 110. The pixel circuit 100 also includes the compensation unit 130 that can provide the OLED 110 with the compensation current Ic corresponding to the compensation data signal CDT based on the level of the anode current Ian. The pixel circuit 100 can individually compensate for the decreased amount of the anode current Ian which is caused by at least one of the degradation of the OLED 110 and the voltage drop of the first high power supply voltage ELVDD1 according to a position of the pixel circuit 100.

Figure 2:
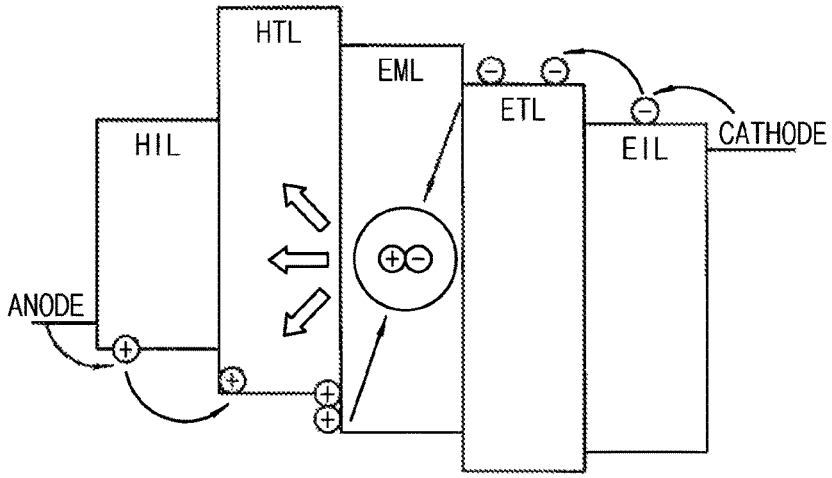
FIG. 2 is a conceptual diagram of the OLED in FIG. 1.

FIG. 2 is a conceptual diagram of the OLED 110 in FIG. 1.

Referring to FIG. 2, the OLED 110 can include an anode (formed of indium tin oxide (ITO), for example), an organic thin film and a cathode (a metal, for example). The organic thin film can include an emissive later (EML), an electron transport layer (ETL) and a hole transport layer (HTL). In addition, the organic thin film can further include a hole injection layer (HIL) or an electron injection layer (EIL).

Figure 3:
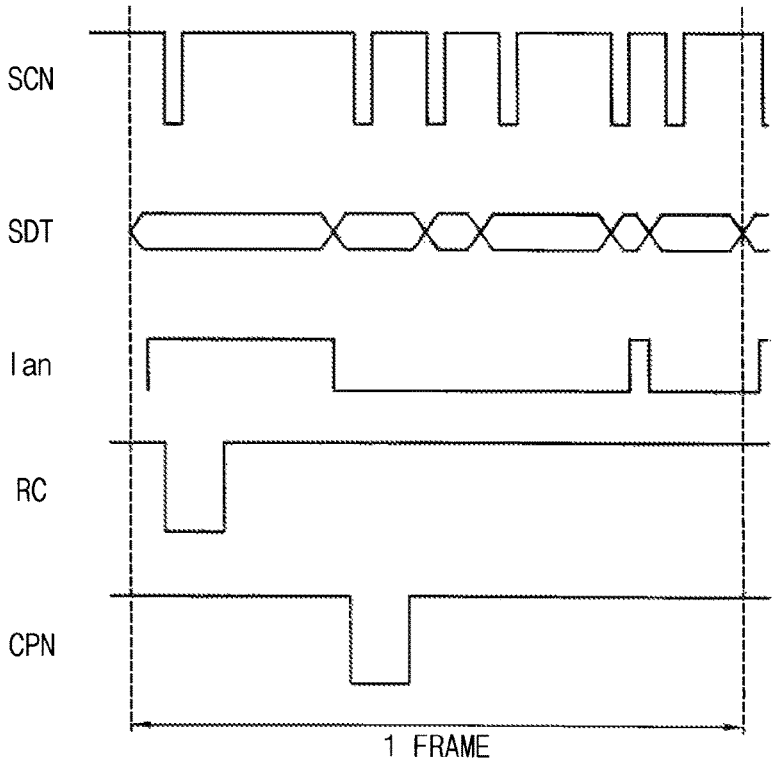
FIG. 3 is a timing diagram illustrating an operation of the pixel circuit of FIG. 1.

FIG. 3 is a timing diagram illustrating an operation of the pixel circuit 100 of FIG. 1.

Hereinafter, the operation of the pixel circuit 100 of FIG. 1 will be described with reference to FIGS. 1 and 3.

Referring to FIGS. 1 and 3, the data signal SDT, comprising a frame, is input to the driving unit 120 through the data line DLi. Because the pixel circuit 100 can produce grayscale with a digital driving method, the frame can be divided into a plurality of sub-frames, and each sub-frame can include a scan period and a light-emitting period. For representing a grayscale, the driving unit 120 can store the data signal SDT during the scan period (while the scan signal SCN is at the low level) of each sub-frame, and can selectively emit light according to the stored data signal during the light-emitting period of each sub-frame.

The first driving transistor 125 can be turned on or turned off according to the driving voltage Vg during the light-emitting period. The anode current Ian can have a high level (i.e., a white current) or a low level (i.e., a black current) according to the data signal SDT. The third switching transistor 141 is turned on in response to the read control signal RC which is activated with a low level while the anode current Ian is the white current and the anode current Ian is provided to a data driver 400 (refer to FIG. 5) through the read line RLi. The data driver 400 can provide the compensation unit 130 with the compensation data signal CDT. While the read control signal RC is deactivated with the high level, the compensation control signal CPN can be activated with the low level and the compensation data signal CDT can be stored in the compensation capacitor 137. The compensation voltage Vc corresponding to the compensation data signal CDT is applied to the second driving transistor 131 and the compensation current Ic can be provided to the OLED 110.

As is noted with reference to FIG. 3, the driving unit 120 can perform a driving operation per each sub-frame, the read-out unit 140 can perform a read-out operation independently from the driving unit 120 and the compensation unit 130 can perform a compensation operation independently from the driving unit 120. That is, the compensation unit 130 and the read-out unit 140 can respectively perform the compensation operation and read-out operation once every few frames or a few dozens of frames. In addition, in some embodiments, the read-out operation of the read-out unit 140 and a compensation operation of the compensation unit 130 do not overlap with respect to each other When the read-out unit 140 performs the read-out operation after the compensation unit 130 performs the compensation operation, the anode current Ian can reflect a threshold voltage deviation of the driving transistors 131 and 133. Therefore, the compensation unit 130 can compensate for the decreased amount of the anode current Ian due to the threshold voltage deviation of the driving transistors 131 and 133 in the next compensation operation.

Figure 4:
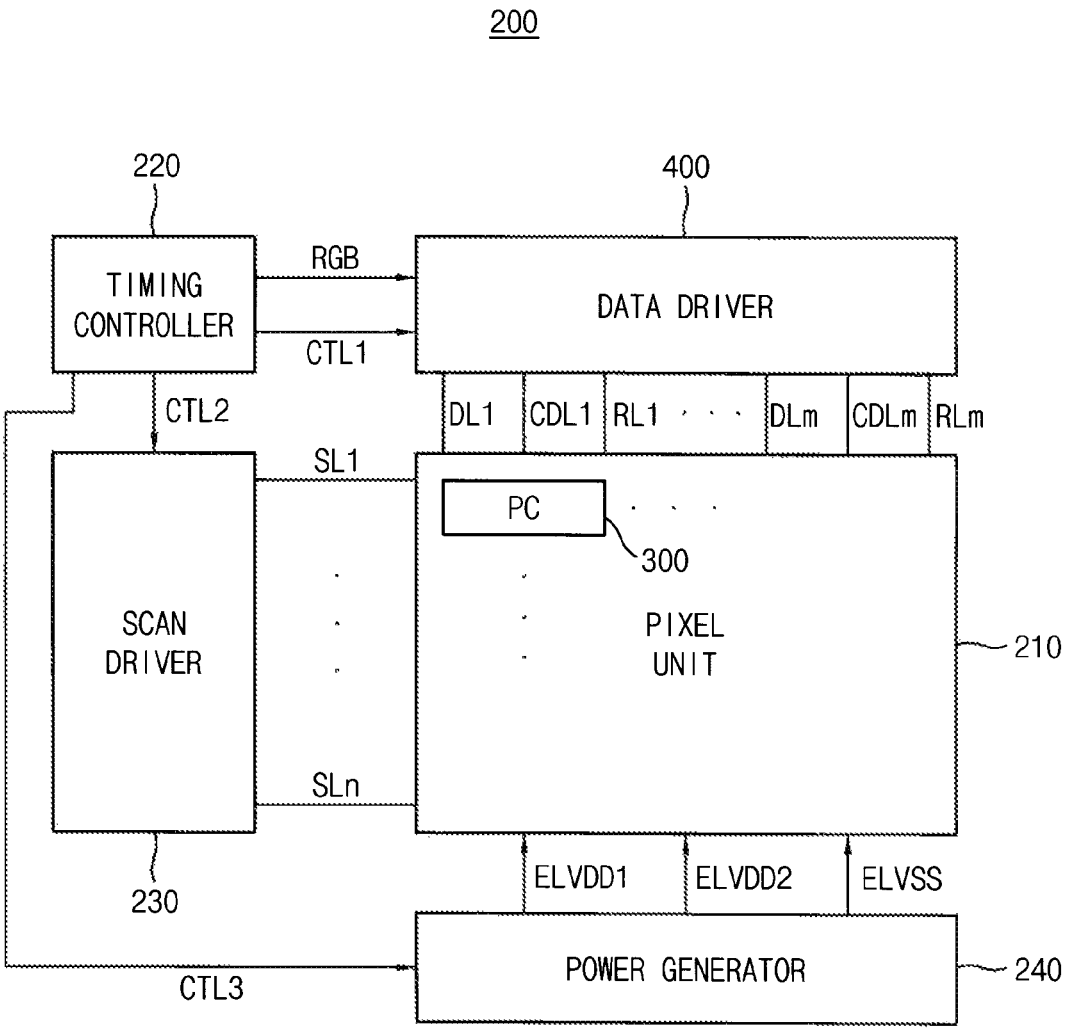
FIG. 4 is a block diagram illustrating an OLED display according to example embodiments.

FIG. 4 is a block diagram illustrating an OLED display according to example embodiments.

Referring to FIG. 4, an OLED display 200 can include a pixel unit 210, a timing controller 220, a scan driver 230, a data driver 400 and a power generator or power supply 240. In some embodiments, the timing controller 220, the scan driver 230, the data driver 400 and the power generator 240 can be implemented as a single integrated circuit (IC). In some embodiments, the timing controller 220, the scan driver 230, the data driver 400 and the power generator 240 can be implemented as separate ICs.

The pixel unit 210 can be coupled to the scan driver 230 via a plurality of scan lines SL1, . . . , SLn, and can be coupled to the data driver 400 via a plurality of data lines DL1, . . . , DLm, a plurality of compensation data lines CDL1, . . . , CDLm and a plurality of read lines RL1, . . . , RLm. The pixel unit 210 can include a plurality of n*m pixel circuits 300. Each pixel circuit 300 can be located at crossing points of the scan lines SL1, . . . , SLn and the data lines DL1, DLm.

The pixel unit 210 can be supplied with the first high power supply voltage ELVDD1, the second high power supply voltage ELVDD2 and the low power supply voltage ELVSS from the power generator 240. The level of the second high power supply voltage ELVDD2 can be substantially equal to or greater than the level of the first high power supply voltage ELVDD1.

The scan driver 230 can provide a scan signal to each pixel circuit 300 via the scan lines SL1, . . . , SLn. The data driver can provide a data signal to each pixel circuit 300 via the data lines DL1, . . . , DLm, can receive an anode current from each pixel circuit 300 via the read lines RL1, . . . , RLm and can provide a compensation data signal to each pixel circuit 300 via the compensation data lines DL1, . . . , DLm.

The timing controller 220 can control the scan driver 230, the data driver 400 and the power generator 240 by generating and providing a plurality of timing control signals CTL1, CTL2 and CTL3 to the scan driver 230, the data driver 400 and the power generator 240, respectively. The data driver 400 can generate the compensation control signal CPN and the read control signal RC in response to the control signal CTL1. In addition, the timing controller 240 can provide an input image data RGB to the data driver 400.

The power generator 240 can supply the first high power supply voltage ELVDD1, the second high power supply voltage ELVDD2 and the low power supply voltage ELVSS to each pixel circuit 300.

Each pixel circuit 300 can be the pixel circuit 100 of FIG. 1 or a similar pixel circuit. Therefore, each pixel circuit 300 can include a read-out unit for detecting the anode current Ian of the OLED and a compensation unit that can provide the OLED with a compensation current corresponding to a compensation data signal based on the level of the anode current Ian. Each pixel circuit 300 can individually compensate for the decreased amount of the anode current Ian which is caused by at least one of the deterioration of the OLED and the voltage drop of the first high power supply voltage ELVDD1 according to a position of the pixel circuit 300.

Figure 5:
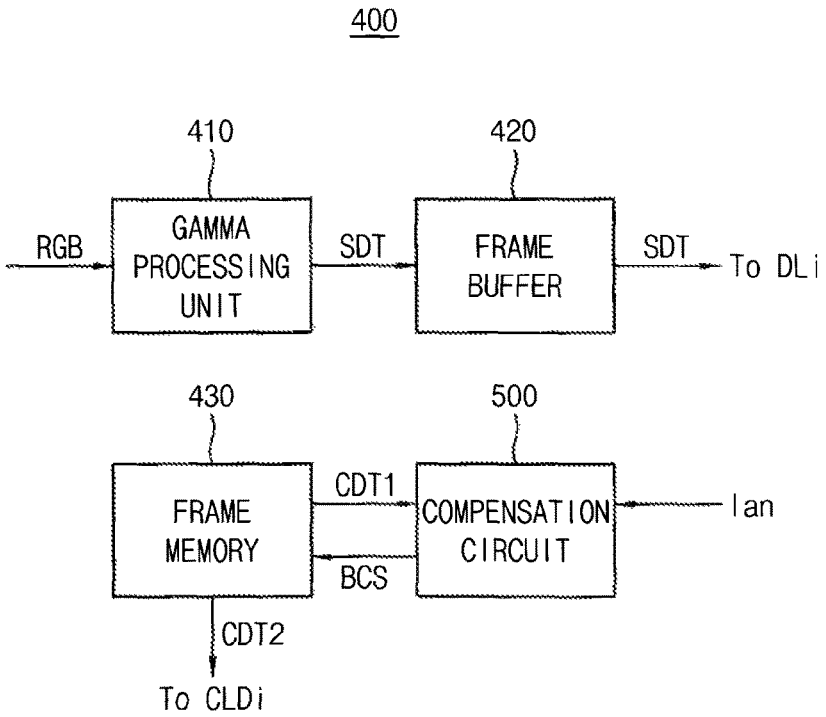
FIG. 5 is a block diagram illustrating the data driver illustrated in FIG. 4 according to example embodiments.

FIG. 5 is a block diagram illustrating the data driver 400 illustrated in FIG. 4 according to example embodiments.

Referring to FIG. 5, the data driver 400 can include a gamma processing unit 410, a frame buffer 420, a frame memory 430 and a compensation circuit 500.

The gamma processing unit 410 can receive the input image data RGB from the timing controller 200. The gamma processing unit 410 can perform gamma conversion on the input image data RGB to generate the data signal SDT. The gamma processing unit 410 can output the data signal SDT to the frame buffer 420. The frame buffer 420 can provide the data signal SDT to the pixel unit 210 through the data line DLi under control of the timing controller 220.

The frame memory 430 can store compensation data CDT associated with each pixel circuit 300. For storing the compensation data CDT in the frame memory 430, the same test data is applied to each pixel circuit 300; an anode current read from each pixel circuit 300 is compared with a target current corresponding to the test data; the difference between the target current and the anode current for each pixel circuit 300 and a value corresponding to the difference between the target current and the anode current can be stored as the compensation data CDT in the frame memory 430.

The frame memory 430 can provide the compensation circuit 500 with the compensation data CDT of a corresponding pixel circuit as a first compensation data CDT1 under control of the timing controller 220. The compensation circuit 500 can receive the first compensation data CDT1 of the corresponding pixel circuit and the anode current Ian of the corresponding pixel circuit, can compare a level of a first compensation current converted from the first compensation data CDT1 with the level of the anode current Ian and can output a bit control signal BCS directing whether bits of the compensation data CDT stored in the frame memory 430 are to be changed according to a comparison result. For example, when the difference between the levels of the first compensation current and the anode current Ian is substantially equal to or greater than a reference current, the compensation circuit 500 can change at least one bit of the compensation data CDT stored in the frame memory 430 using the bit control signal BCS. In another example, when the difference between the levels of the first compensation current and the anode current Ian is smaller than the reference current, the compensation circuit 500 can maintain bits of the compensation data CDT stored in the frame memory 430 using the bit control signal BCS.

The frame memory 430 can provide the corresponding pixel circuit with the compensation data CDT having changed bits or maintained bits as a second compensation data CDT2 through the compensation data line CDLi.

Figure 6:
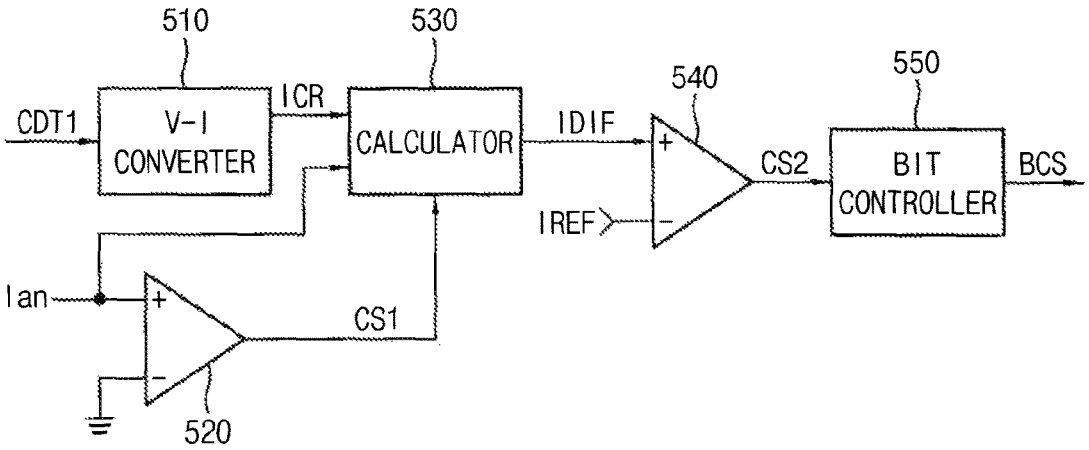
FIG. 6 is a block diagram illustrating the compensation circuit in FIG. 5 according to example embodiments.

FIG. 6 is a block diagram illustrating the compensation circuit 500 in FIG. 5 according to example embodiments.

Referring to FIG. 6, the compensation circuit 500 can include a voltage-to-current converter 510, a first comparator 520, a calculator 530, a second comparator 540 and a bit controller 550.

The voltage-to-current converter 510 can convert the first compensation data CDT1 of a pixel circuit to a first compensation current ICR. The first comparator 520 can compare the anode current Ian of the corresponding pixel circuit with a zero current and provide the calculator 530 with a first comparison signal CS1 indicating the comparison result.

For example, when the OLED 110 does not emit light in response to the data signal SDT, the level of the anode current Ian is substantially the same as the zero current and the first comparison signal CS1 can have a first logic level (low level). The calculator 530 can be disabled in response to the first comparison signal CS1 having a low level. That is, when the OLED 110 does not emit light in response to the data signal SDT, the anode current Ian is a black current and the compensation operation is not performed on a pixel circuit, which receives a black image.

For example, when the OLED 110 emits light in response to the data signal SDT in the pixel circuit 100, the level of the anode current Ian is greater than the zero current, and the first comparison signal CS1 can have a second logic level (high level). The calculator 530 can be enabled in response to the first comparison signal CS1 having a high level. That is, when the OLED 110 emits light in response to the data signal SDT, the anode current Ian is a white current and the compensation operation is performed on a pixel circuit, which receives a white image.

The calculator 530 can be enabled in response to the first comparison signal CS1 having a high level, and can calculate a difference between the anode current Ian and the first compensation current ICR to output a difference current IDIF. That is, the difference current IDIF can represent the difference of levels between the anode current Ian and the first compensation current ICR.

The second comparator 540 can compare the difference current IDIF with a reference current IREF and output a second comparison signal CS2 corresponding to the comparison result. For example, when the difference current IDIF is less than the reference current IREF, the second comparison signal CS2 can have a first logic level (low level). In another example, when the difference current IDIF is substantially equal to or greater than the reference current IREF, the second comparison signal CS2 can have a second logic level (high level).

The bit controller 550 can provide the frame memory 430 with the bit control signal BCS, which determines whether the compensation data CDT of the corresponding pixel circuit stored in the frame memory 430 is to be updated according to a logic level of the second comparison signal CS2. The frame memory 430 can update (or change) or maintain bits of the compensation data CDT in response to the bit control signal BCS and can provide the compensation unit of the corresponding pixel circuit with the compensation data CDT as the second compensation data CDT2.

For example, when the difference current IDIF is less than the reference current IREF, the bit controller 550 can output the bit control signal BCS to the frame memory 450 such that the bits of the compensation data CDT can be maintained. In another example, when the difference current IDIF is substantially equal to or greater than the reference current IREF, the bit controller 550 can output the bit control signal BCS to the frame memory 450 such that the bits of the compensation data CDT can be increased thereby to decrease the level of the compensation voltage Vc. When the bits of the compensation data CDT are increased, the level of the compensation data CDT is increased. When the level of the compensation data CDT is increased, the level of the compensation voltage Vc is decreased, and the level of the compensation current Ic provided to the OLED 110 can be increased when the third driving transistor 133 is turned on in FIG. 1. The reference current IREF can have a threshold value. When the difference between the anode current Ian the first compensation current ICR is greater than the reference current IREF, the OLED 110 does not emit light as desired. The threshold value can be determined through testing the OLED 110.

Figure 7:
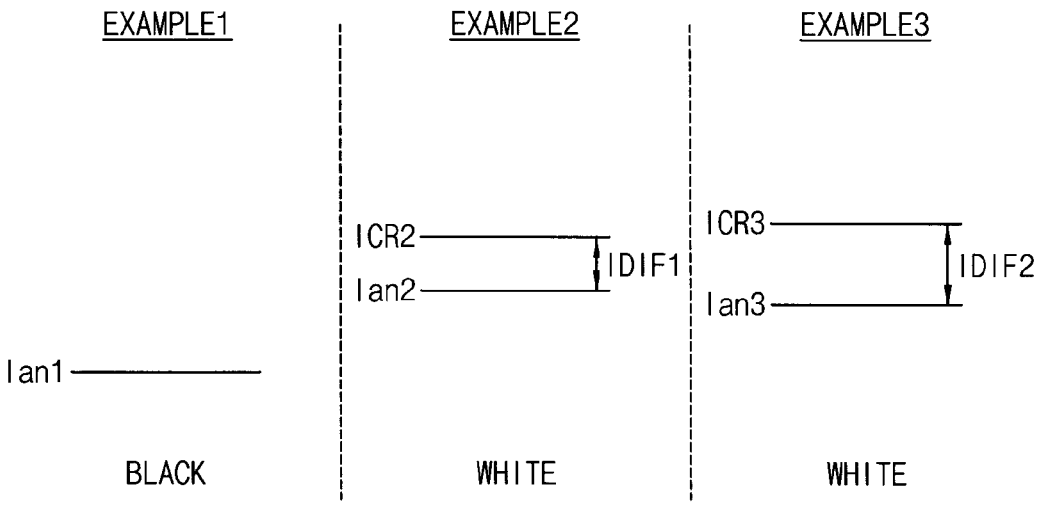
FIG. 7 illustrates operation of the compensation circuit of FIG. 6 according to levels of the anode current.

FIG. 7 illustrates an operation of the compensation circuit 500 of FIG. 6 according to levels of the anode current.

In FIG. 7, a first example EXAMPLE1 represents an example when the level of an anode current Ian1 of the pixel circuit 300 is substantially the same as the zero current. When the level of the anode current Ian1 is substantially the same as the zero current, the first comparison signal CS1 is a low level and the calculator 530 is disabled in response to the first comparison signal CS1 having the low level. Therefore, the compensation unit 500 in the pixel circuit 300 does not perform the compensation operation when the anode current Ian1 is a black current.

In FIG. 7, a second example EXAMPLE2 represents an example when the level of an anode current Ian2 of the pixel circuit 300 is a white current, not the zero current. When the level of the anode current Ian2 is the white current, the first comparison signal CS1 is a high level and the calculator 530 is enabled in response to the first comparison signal CS1 having the high level. The enabled calculator 530 calculates the difference between the anode current Ian2 and a first compensation current ICR2 and outputs a difference current IDIF1. In the second example EXAMPLE2, when the difference current IDIF1 is less than the reference current IREF, the second comparison signal CS2 is the low level. The bit controller 550 provides the bit control signal BCS to the frame memory 430 such that the bits of the compensation data CDT can be maintained, in response to the second comparison signal CS2 having the low level.

In FIG. 7, a third example EXAMPLE3 represents an example when the level of an anode current Ian3 of the pixel circuit 300 is a white current, not the zero current. When the level of the anode current Ian3 is the white current, the first comparison signal CS1 is a high level and the calculator 530 is enabled in response to the first comparison signal CS1 having the high level. The enabled calculator 530 calculates the difference between the anode current Ian3 and a first compensation current ICR3 and outputs a difference current IDIF2. In the third example EXAMPLE3, when the difference current IDIF3 is greater than the reference current IREF, the second comparison signal CS2 is a high level. The bit controller 550 provides the bit control signal BCS to the frame memory 430 such that the bits of the compensation data CDT can be changed (or updated) in response to the second comparison signal CS2 having the high level. The frame memory 430 can provide the compensation unit 500 with the compensation data CDT2 having increased bits in response to the bit control signal BCS. When the bits of the compensation data CDT are increased, the level of the compensation voltage Vc is decreased. Therefore, the level of the compensation current Ic provided to the OLED 110 is increased while the third driving transistor 133 in FIG. 1 is turned on.

In FIG. 7, when the white data is input and the OLED 110 needs to emit light, the level of the anode current Ian can be different for each pixel circuit because of i) a relative position of each pixel circuit with respect to the power generator 240 in the OLED display 200 of FIG. 4, ii) a deterioration of the OLED of the corresponding pixel circuit or iii) distribution of the threshold voltages of the transistors in the corresponding pixel circuit. The first high power supply voltage ELVDD1 from the power generator 240 in FIG. 4 is supplied to the corresponding pixel circuit through a power line and a length of the power line is different according to the relative position of the corresponding pixel circuit with respect to the power generator 240. Because the power line has internal resistance, a voltage drop due to the resistance can be different according to the relative position of each pixel circuit with respect to the power generator 240.

In addition, when the OLED generates grayscale in the digital driving manner, transistors in each pixel circuit operates in a linear region. Therefore, the characteristics of the OLED can greatly influence the anode current of the OLED. In addition, because the digital driving method is a constant voltage driving method for the OLED, the anode current can be decreased when the OLED is electrically deteriorated.

The pixel circuit 100 and the OLED display 200 according to some embodiments can compensate for the decreased amount of the anode current caused by various reasons. That is, the pixel circuit 100 can decrease level of the compensation voltage Vc by increasing the level of the compensation data CDT when the level of the anode current Ian of the corresponding pixel circuit is decreased.

Figure 8:
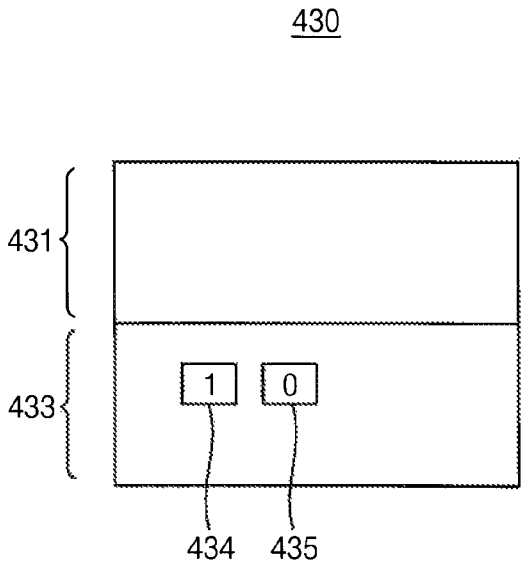
FIG. 8 illustrates the frame memory in FIG. 5 according to example embodiments.

FIG. 8 illustrates the frame memory 430 in FIG. 5 according to example embodiments.

Referring to FIG. 5, the frame memory 430 can include a first region 431 and a second region 433. The first region 431 can store the compensation data CDT of each pixel circuit 300. The second region 433 can store particle bits 434 and 435 each of which represents whether an OLED in each pixel circuit has a contaminating particle or a contaminant.

When the OLED 110 in FIG. 1 has a particle, additional current path can be formed between the anode and cathode of the OLED 110 because the particle is conductive. Therefore, the level of the anode current is increased compared to a case when the OLED 110 does not have a particle. For checking which OLED has a particle, same test data for forcing the OLED 110 to emit light is applied to all of the pixel circuits 300 and the anode current of each pixel circuit 300 is detected. A pixel circuit is determined to have a particle when the anode current of the corresponding pixel circuit is greater than a reference current. A particle bit of a pixel circuit that includes an OLED having a particle is stored in the second region 433 as a high level ('1'). A particle bit of a pixel circuit that includes an OLED having no particle is stored in the second region 433 as a low level ('0'). Therefore, the location of the pixel circuit having particle can be found by reading data in the second region 433.

Figure 9:
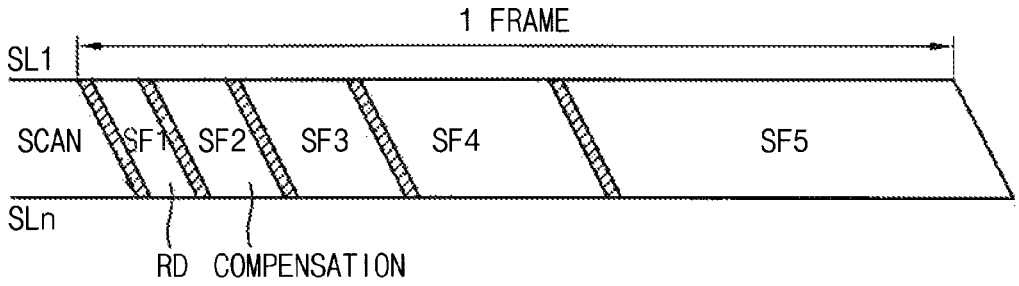
FIG. 9 is a diagram for describing an exemplary operation of the OLED display of FIG. 4.
Figure 10:
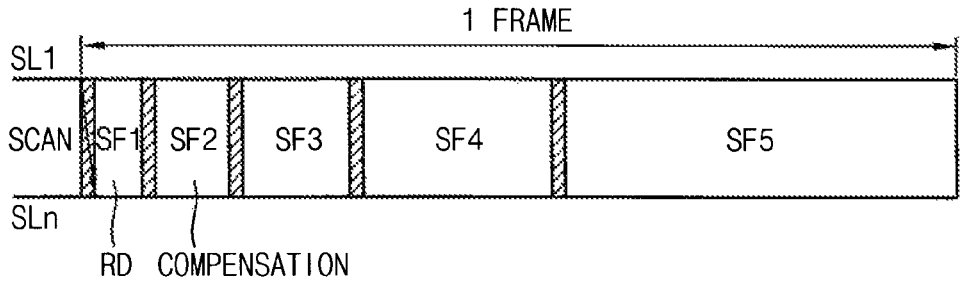
FIG. 10 is a diagram for describing another exemplary operation of an OLED display of FIG. 4.

FIG. 9 is a diagram for describing an example of an operation of the OLED display 200 of FIG. 4. FIG. 10 is a diagram for describing another example of an operation of the OLED display 200 of FIG. 4.

Referring to FIGS. 4, 9 and 10, the OLED display 200 can drive the pixel circuits 300 in a digital driving manner by adjusting a light-emitting time. For example, one frame can be divided into a plurality of sub-frames SF1, SF2, SF3, SF4 and SF5, and each sub-frame can include a scan period (shown with oblique lines in FIGS. 9 and 10) and a light-emitting period. To represent a gray level, each pixel circuit 300 can store a data signal during the scan period of each sub-frame, and can selectively emit light according to the stored data signal during the light-emitting period of each sub-frame.

In some embodiments, as illustrated in FIG. 9, the pixel circuits 300 can sequentially emit light on a scan line basis. For example, after the pixel circuits 300 coupled to a first scan line SL1 are scanned, the pixel circuits 300 coupled to the first scan line SL1 emit light while the pixel circuits 300 coupled to a second scan line SL2 are scanned.

In some embodiments, as illustrated in FIG. 10, the pixel circuits 300 can substantially simultaneously emit light. For example, after all the pixel circuits 300 coupled to the first scan line SL1 through an n-th scan line SLn are scanned, all of the pixel circuits 300 can substantially simultaneously emit light. For example, the first high power supply voltage ELVDD1 can have a low voltage level during the scan period of each sub-frame, and then can transition from the low voltage level to a high voltage level to initiate the light-emitting period of each sub-frame. In other examples, the low power supply voltage ELVSS can have a high voltage level during the scan period of each sub-frame, and then can transition from the high voltage level to a low voltage level to initiate the light-emitting period of each sub-frame. This simultaneous light-emitting method can be applied when the OLED display 200 displays a stereoscopic image.

In FIGS. 9 and 10, the read-out operation for each pixel circuit 300 can be performed during the sub-frame SF1 and the compensation operation for each pixel circuit 300 can be performed during the sub-frame SF2.

Figure 11:
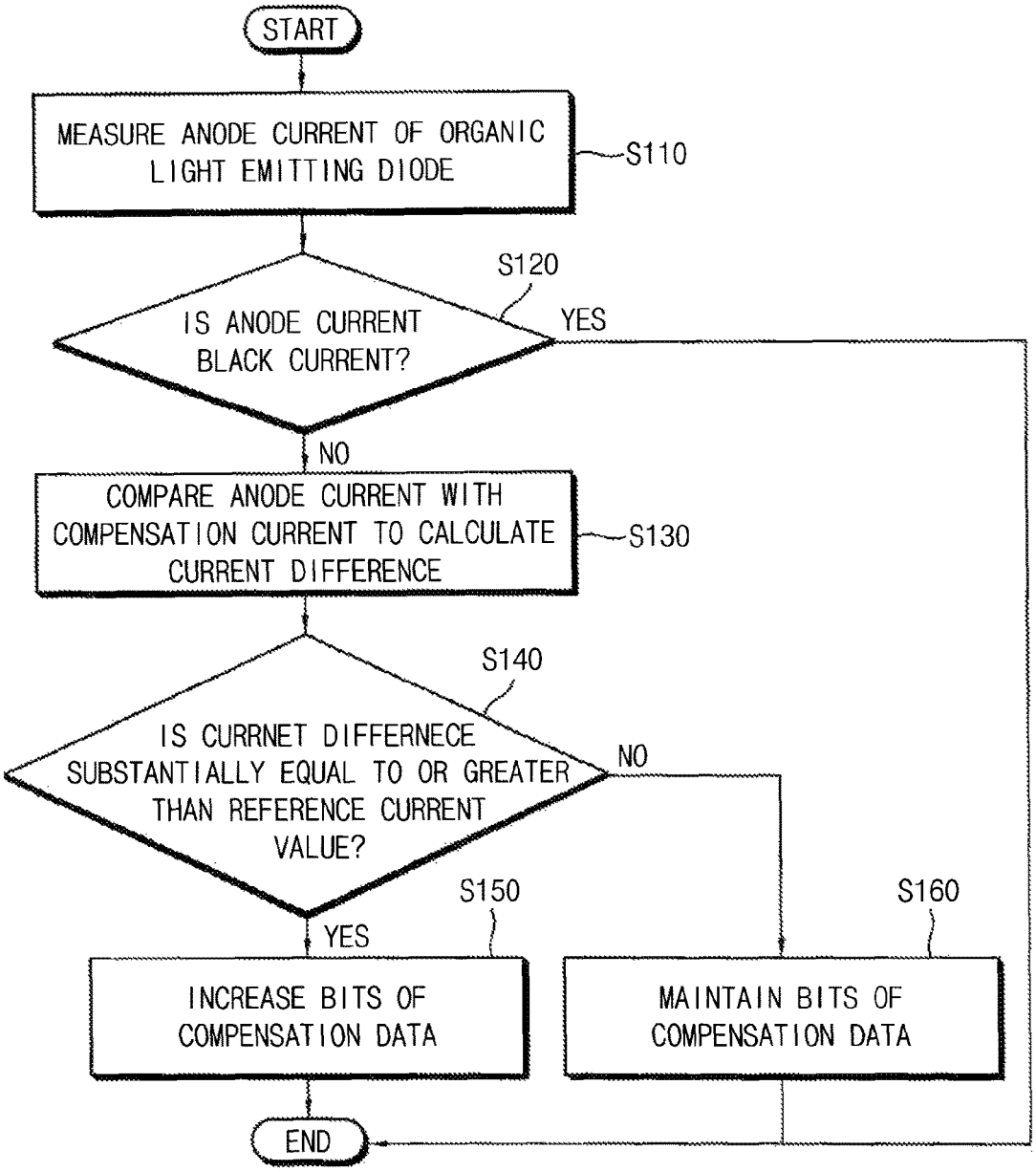
FIG. 11 is a flowchart illustrating a method of driving an OLED display of FIG. 4 according to example embodiments.

FIG. 11 is a flowchart illustrating a method of driving the OLED display 200 of FIG. 4 according to example embodiments.

In some embodiments, the FIG. 11 procedure is implemented in a conventional programming language, such as C or C++ or another suitable programming language. The program can be stored on a computer accessible storage medium of the OLED display, for example, a memory (not shown) of the OLED display 200 or the timing controller 220. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 11.

Hereinafter, a method of driving an OLED display with reference to FIGS. 1, 3 and 4 through 11 will be described.

The read-out unit 140 detects or measures the anode current Ian of the OLED 110 (S110). The compensation circuit 500 in FIG. 5 determines whether the anode current Ian is a black current (S120). When the current Ian is the black current, that is, when the anode current Ian is zero current (YES in S120), the compensation operation is not performed. When the current Ian is not the black current (NO in S120), the compensation circuit 500 compares the anode current Ian with the first compensation current ICR, corresponding to the compensation data CDT, to calculate the difference current IDIF, corresponding to the difference between the anode current Ian and the first compensation current ICR (S130). The compensation circuit 500 determines whether the difference current IDIF is greater than the reference current IREF (S140). When the difference current IDIF is less than the reference current IREF (NO in S140), the bit controller 550 outputs the bit control signal BCS to the frame memory 430 such that the bits of the compensation data CDT are maintained (S160). When the difference current IDIF is substantially equal to or greater than the reference current IREF (YES in S140), the bit controller 550 outputs the bit control signal BCS to the frame memory 430 such that the bits of the compensation data CDT are increased (S150).

Figure 12:
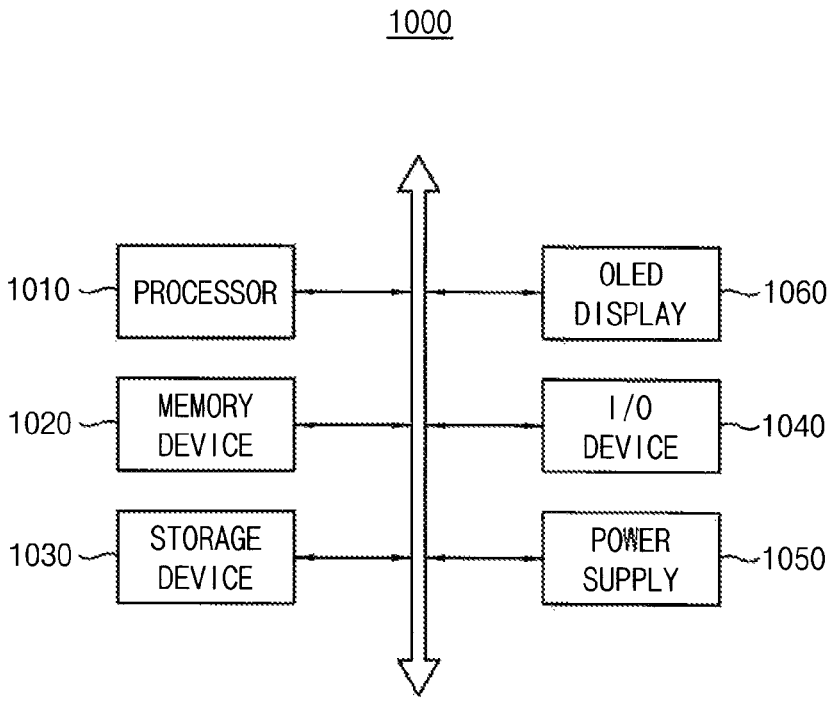
FIG. 12 is a block diagram illustrating an electronic system including an OLED display according to example embodiments.

FIG. 12 is a block diagram illustrating an electronic system 1000 including an OLED display according to example embodiments.

Referring to FIG. 12, the electronic system 1000 includes a processor 1010, a memory device 1020, a storage device 1030, an input/output (I/O) device 1040, a power supply 1050, and an OLED display 1060. The electronic system 1000 can further include a plurality of ports for communicating a video card, a sound card, a memory card, a universal serial bus (USB) device, other electronic systems, etc.

The processor 1010 can perform various computing functions or tasks. The processor 1010 can be for example, a microprocessor, a central processing unit (CPU), etc. The processor 1010 can be connected to other components via an address bus, a control bus, a data bus, etc. Further, the processor 1010 can be coupled to an extended bus such as a peripheral component interconnection (PCI) bus.

The memory device 1020 can store data for operations of the electronic system 1000. For example, the memory device 1020 can include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1030 can be, for example, a solid state drive (SSD) device, a hard disk drive (HDD) device, a CD-ROM device, etc. The I/O device 1040 can be, for example, an input device such as a keyboard, a keypad, a mouse, a touch screen, etc., and/or an output device such as a printer, a speaker, etc. The power supply 1050 can supply power for operations of the electronic system 1000. The OLED display 1060 can communicate with other components via the buses or other communication links.

The OLED display 1060 can include the OLED display 200 of FIG. 4. The OLED display 1060 includes a plurality of pixel circuits and each of the pixel circuits can be the pixel circuit 100 of FIG. 1 or a similar pixel circuit. Therefore, each pixel circuit can include a read-out unit for detecting the anode current Ian of the OLED and a compensation unit that can provide the OLED with a compensation current corresponding to a compensation data signal based on the level of the anode current Ian. Each pixel circuit can individually compensate for the decreased amount of the anode current Ian which is caused by at least one of the deterioration of the OLED and the voltage drop of the first high power supply voltage according to a position of the pixel circuit.

Some embodiments can be applied to any electronic system 1000 having the OLED display 1060. For example, some embodiments can be applied to the electronic system 1000, such as a television, a computer monitor, a laptop, a digital camera, a cellular phone, a smart phone, a personal digital assistant (PDA), a portable multimedia player (PMP), a MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A pixel circuit for displaying an image, comprising:

an organic light-emitting diode (OLED) electrically connected between a first node and a low power supply voltage;

a driver electrically connected to the OLED at the first node and configured to drive the OLED with a voltage corresponding to a data signal based at least in part on a scan signal;

a read-out unit configured to measure an anode current of the OLED based at least in part on a read control signal; and a compensation unit electrically connected to the OLED at the first node and configured to provide the OLED with a compensation current corresponding to a compensation data signal based on the amount of anode current, a compensation control signal and the scan signal, wherein the compensation unit includes a compensation capacitor directly connected to a higher power supply voltage having a voltage greater than that of the low power supply voltage, and wherein the driver comprises:

a first switching transistor configured to, based at least in part on the scan signal, transmit the data signal received from a data line;

a storage capacitor configured to store the data signal transmitted through the first switching transistor, wherein the storage capacitor is electrically connected to a first high power supply voltage on one end and the first switching transistor on the other end at a second node; and a first driving transistor configured to drive the OLED based at least in part on a driving voltage at the second node, wherein the driving voltage is based at least in part on the data signal stored in the storage capacitor, and wherein the compensation unit comprises:

a second switching transistor configured to, based at least in part on the compensation control signal, transmit the compensation data signal received from a compensation data line;

a compensation capacitor configured to store the compensation data signal transmitted from the second switching transistor and electrically connected to a second high power supply voltage on one end and electrically connected to the second switching transistor on the other end at a third node;

a second driving transistor configured to be turned on or turned off based at least in part on a compensation voltage at the third node, wherein the compensation voltage is based at least in part on the compensation data signal stored in the compensation capacitor; and a third driving transistor configured to be turned on or turned off based at least in part on the driving voltage at the second node and electrically connected between the second driving transistor and the first node.

2. The pixel circuit of claim 1, wherein the first switching transistor includes a first p-channel metal oxide semiconductor (PMOS) transistor having a first terminal electrically connected to the data line, a gate terminal configured to receive the scan signal and a second terminal electrically connected to the second node, and wherein the first driving transistor includes a second PMOS transistor having a first terminal electrically connected to the first high power supply voltage, a gate terminal electrically connected to the second node and a second terminal electrically connected to the first node.

3. The pixel circuit of claim 1, wherein the second switching transistor includes a first p-channel metal oxide semiconductor (PMOS) transistor having a first terminal electrically connected to the compensation data line, a gate terminal configured to receive the compensation control signal and a second terminal electrically connected to the third node, wherein the second driving transistor includes a second PMOS transistor having a first terminal electrically connected to the second high power supply voltage, a gate terminal electrically connected to the third node and a second terminal electrically connected to the first PMOS transistor, and wherein the third driving transistor includes a third PMOS transistor having a first terminal electrically connected to the first driving transistor, a gate terminal electrically connected to the second node and a second terminal electrically connected to the first node.

4. The pixel circuit of claim 3, wherein the OLED is configured to receive the compensation current when the second and third PMOS transistors are turned on.

5. The pixel circuit of claim 1, wherein a level of the second high power supply voltage is substantially equal to or greater than a level of the first high power supply voltage.

6. The pixel circuit of claim 1, wherein, when the OLED emits light based at least in part on the data signal, a level of the compensation voltage is proportional to a level of the measured anode current.

7. The pixel circuit of claim 1, wherein the read-out unit comprises:

a read-out switching transistor configured to provide the anode current to a read line based at least in part on the read control signal, wherein the read-out switching transistor includes a p-channel metal oxide semiconductor (PMOS) having a first terminal configured to receive the anode current, a gate terminal configured to receive the read control signal and a second terminal electrically connected to the read line.

8. The pixel circuit of claim 1, wherein the read-out unit and the compensation unit are configured to operate independently with respect to the driver.

9. The pixel circuit of claim 8, wherein the read-out unit is further configured to measure the anode current, and wherein the compensation unit is further configured to provide the compensation current at different times.

10. The pixel circuit of claim 8, wherein, when the OLED does not emit light, the compensation unit is further configured to not output the compensation current to the OLED.

11. An organic light-emitting diode (OLED) display for displaying an image, the OLED display comprising:

a plurality of pixel circuits, wherein each pixel circuit comprises:

an OLED electrically connected between a first node and a low power supply voltage;

an OLED driver electrically connected to the OLED at the first node and configured to drive the OLED with a voltage corresponding to a data signal based at least in part on a scan signal;

a read-out unit configured to measure an anode current of the OLED based at least in part on a read control signal; and a compensation unit electrically connected to the OLED at the first node and configured to provide the OLED with a compensation current corresponding to a compensation data signal based on the amount of anode current, a compensation control signal and the scan signal, wherein the compensation unit includes a compensation capacitor directly connected to a higher power supply voltage having a voltage greater than that of the low power supply voltage;

a data driver electrically connected to the pixel circuits through a plurality of data lines, a plurality of compensation lines and a plurality of read lines, wherein the data driver comprises i) a frame memory configured to store compensation data of each pixel circuit and ii) a compensation circuit configured to selectively update the compensation data based at least in part on the anode current and the compensation data;

a scan driver electrically connected to the pixel circuits through a plurality of scan lines;

a timing controller configured to provide control signals to the scan driver and the data driver; and a power supply configured to supply a plurality of power supply voltages including the low power supply voltage to the pixel unit, wherein the compensation unit comprises:

a voltage-to-current converter configured to convert a first compensation data stored in the frame memory to a first compensation data;

a first comparator configured to compare the anode current with a zero current so as to output a first comparison signal;

a calculator configured receive the first comparison signal and calculate, based at least in part on the first comparison signal, the difference between the anode current and the first compensation current so as to output a difference current;

a second comparator configured to compare the difference current to a reference current so as to output a second comparison signal; and a bit controller configured to, based at least in part on the second comparison signal, generate a bit control signal so as to update the compensation data.

12. The OLED display of claim 11, wherein the calculator is further configured to be disabled based at least in part on the first comparison signal when the anode current is substantially equal to the zero current.

13. The OLED display of claim 11, wherein the calculator is further configured to be enabled based at least in part on the first comparison signal when the anode current is greater than the zero current, and wherein the bit controller is further configured to generate the bit control signal based at least in part on the second comparison signal so as to maintain the compensation data when the difference current is substantially equal to or less than the reference current.

14. The OLED display of claim 11, wherein the calculator is further configured to be enabled based at least in part on the first comparison signal when the anode current is greater than the zero current, and wherein the bit controller is further configured to generate the bit control signal based at least in part on the second comparison signal so as to change the compensation data when the difference current is greater than the reference current.

15. The OLED display of claim 11, wherein the frame memory comprises:

a first region configured to store the compensation data of each pixel circuit; and a second region configured to store particle bits, each particle bit configured to indicate whether the OLED in each pixel circuit has a contaminating particle.

16. The OLED display of claim 11, wherein, when the OLED emits light based at least in part on the data signal, the compensation unit is further configured to generate the compensation current having a level that compensates for a decreased amount of the anode current, and wherein the decreased amount of the anode current is caused by at least one of a degradation of the OLED electrically connected between a high power supply voltage and a low power supply voltage and a voltage drop of the high power supply voltage according to a position of the pixel circuit in the pixel unit.

* * * * *